US006536044B2

(12) United States Patent
Watley

(10) Patent No.: US 6,536,044 B2
(45) Date of Patent: Mar. 25, 2003

(54) COMBINATION HEADNET AND JACKET FOR INSECT CONTROL

(75) Inventor: Bruce E. Watley, Centerville, IA (US)

(73) Assignee: Bug-Out Outdoorwear, Inc., Centerville, IA (US)

( * ) Notice: Subject to any disclaimer, the term of this patent is extended or adjusted under 35 U.S.C. 154(b) by 0 days.

(21) Appl. No.: 09/944,670

(22) Filed: Aug. 31, 2001

(65) Prior Publication Data

US 2002/0056155 A1 May 16, 2002

Related U.S. Application Data

(60) Provisional application No. 60/248,166, filed on Nov. 13, 2000.

(51) Int. Cl.[7] ..... A42B 3/00
(52) U.S. Cl. ..... 2/4
(58) Field of Search ..... 2/4, 79, 202, 206, 2/207, 9, 10, 424, 84, 85, 93, 94, 69, DIG. 1, 69.5, 108, 456, 209.13, 6.3, 6.7, 172, 175.6, 310, 326–328; 135/87, 115, 913; 43/1

(56) References Cited

U.S. PATENT DOCUMENTS 2,189,892 A * 2/1940 Fox ..... 2/4
2,344,811 A * 3/1944 Gill ..... 2/173
2,869,132 A * 1/1959 Drummond ..... 2/174
3,531,952 A * 10/1970 Chesebro ..... 2/202
4,422,184 A 12/1983 Myers
4,685,152 A 8/1987 Heare
5,119,510 A * 6/1992 Schilling ..... 2/202
5,357,635 A 10/1994 Lemoine
5,535,447 A * 7/1996 Stevens et al. ..... 2/202
5,600,850 A 2/1997 Shannon
5,713,076 A * 2/1998 Davis ..... 2/10
5,794,263 A 8/1998 Carman

* cited by examiner

*Primary Examiner*—John J. Calvert
*Assistant Examiner*—Tejash Patel

(57) ABSTRACT

The combination of a headnet and a jacket consisting of open mesh material to protect a wearer from insects. The headnet has a head receiving compartment with an open bottom. The headnet has a lower skirt portion normally extending downwardly from the head of the wearer. A jacket has a body portion, two arm portions, and a closable neck portion normally having a horizontal cross section slightly greater than the neck of a wearer, but less than a horizontal cross section of the skirt portion, whereupon when the closable neck portion is closed around and over the skirt portion in overlapping condition, the skirt portion will be compressed towards the neck of the wearer to inhibit the passage of insects between the overlapping condition of the headnet and the neck portion of the jacket.

5 Claims, 7 Drawing Sheets

COMBINATION HEADNET AND JACKET FOR INSECT CONTROL

CROSS-REFERENCE TO RELATED APPLICATIONS

This application is based upon Applicant's Provisional Patent Application Ser. No. 60/248,166 filed on Nov. 13, 2000.

BACKGROUND OF THE INVENTION

Open mesh fabric has long been used by hunters, fishermen and the like to protect the wearer from mosquitoes and other insects. This apparel includes jackets of this material with or without attached hoods. Separate hoods have been used without regard for any cooperative effect from the jacket.

It is therefore a principal object of this invention to provide a combination headnet and jacket for insect control wherein the structure of the jacket will compliment and enhance the use of a hood.

These and other objects will be apparent to those skilled in the art.

SUMMARY OF THE INVENTION

The combination of a headnet and a jacket consisting of open mesh material to protect a wearer from insects. The headnet has a head receiving compartment with an open bottom. The headnet has a lower skirt portion normally extending downwardly from the head of the wearer. A jacket has a body portion, two arm portions, and a closable neck portion normally having a horizontal cross section slightly greater than the neck of a wearer, but less than a horizontal cross section of the skirt portion, whereupon when the closable neck portion is closed around and over the skirt portion in overlapping condition, the skirt portion will be compressed towards the neck of the wearer to inhibit the passage of insects between the overlapping condition of the headnet and the neck portion of the jacket.

DESCRIPTION OF THE PREFERRED EMBODIMENT

Figure 1:
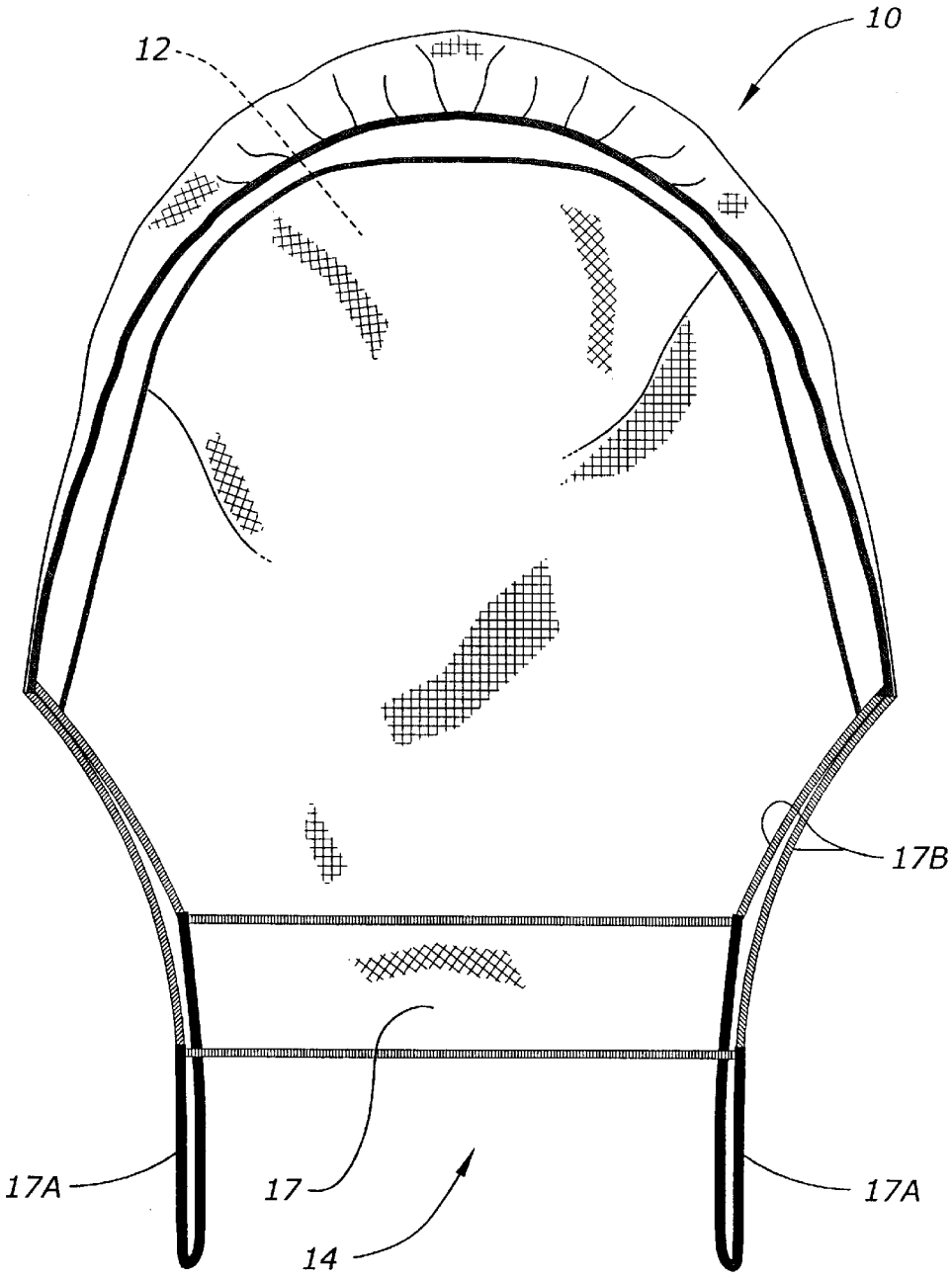
FIG. 1 is a front elevational view of the headnet.
Figure 2:
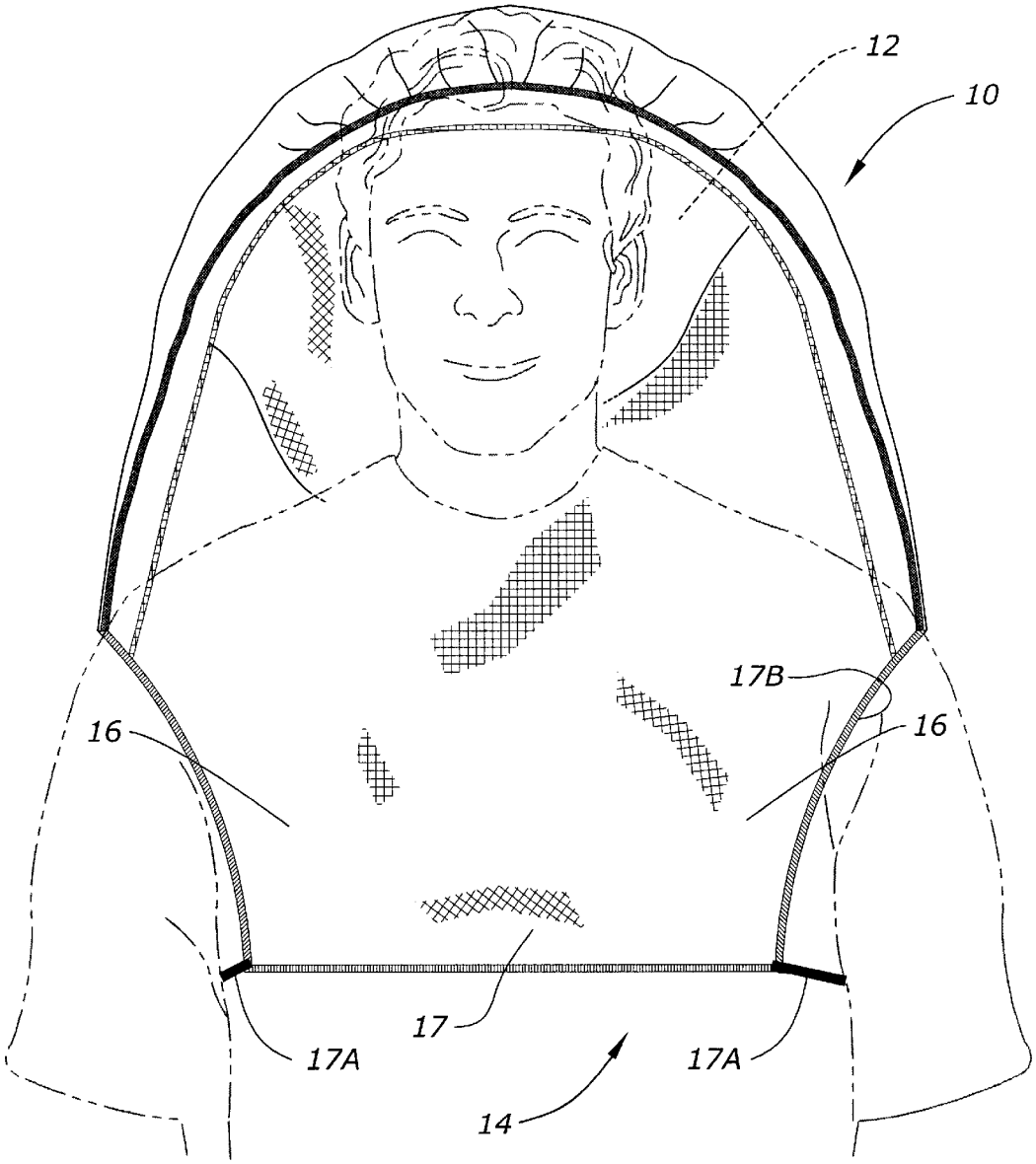
FIG. 2 is a front elevational view of the headnet mounted on wearer.

The numeral 10 designates a headnet having an internal head compartment 12 with an open lower end 14. A skirt portion 16 with skirt flaps 17 comprises the lower portion of the headnet and has a horizontal cross sectional area substantially greater than the neck of an adult person who might be wearing the headnet. The headnet 10 is comprised of a fine open net material capable of admitting light and air, but insufficient to permit passage of small insects such as mosquitoes. A pair of underarm elastic straps 17A form loops which normally fit under the arms of the wearer to hold the headnet on the head of the wearer. The sides of skirt portion 16 and flaps 17 have arcuate portions 17B to conform to the shoulders of the wearer.

Figure 3:
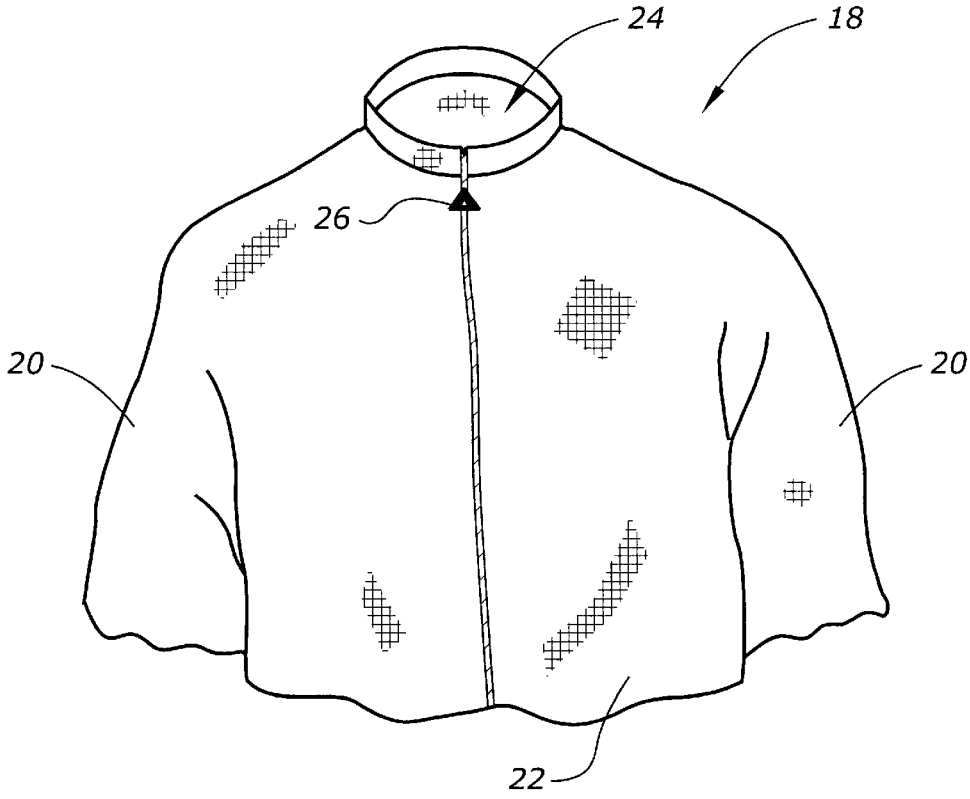
FIG. 3 is a front elevational view of the jacket.
Figure 4:
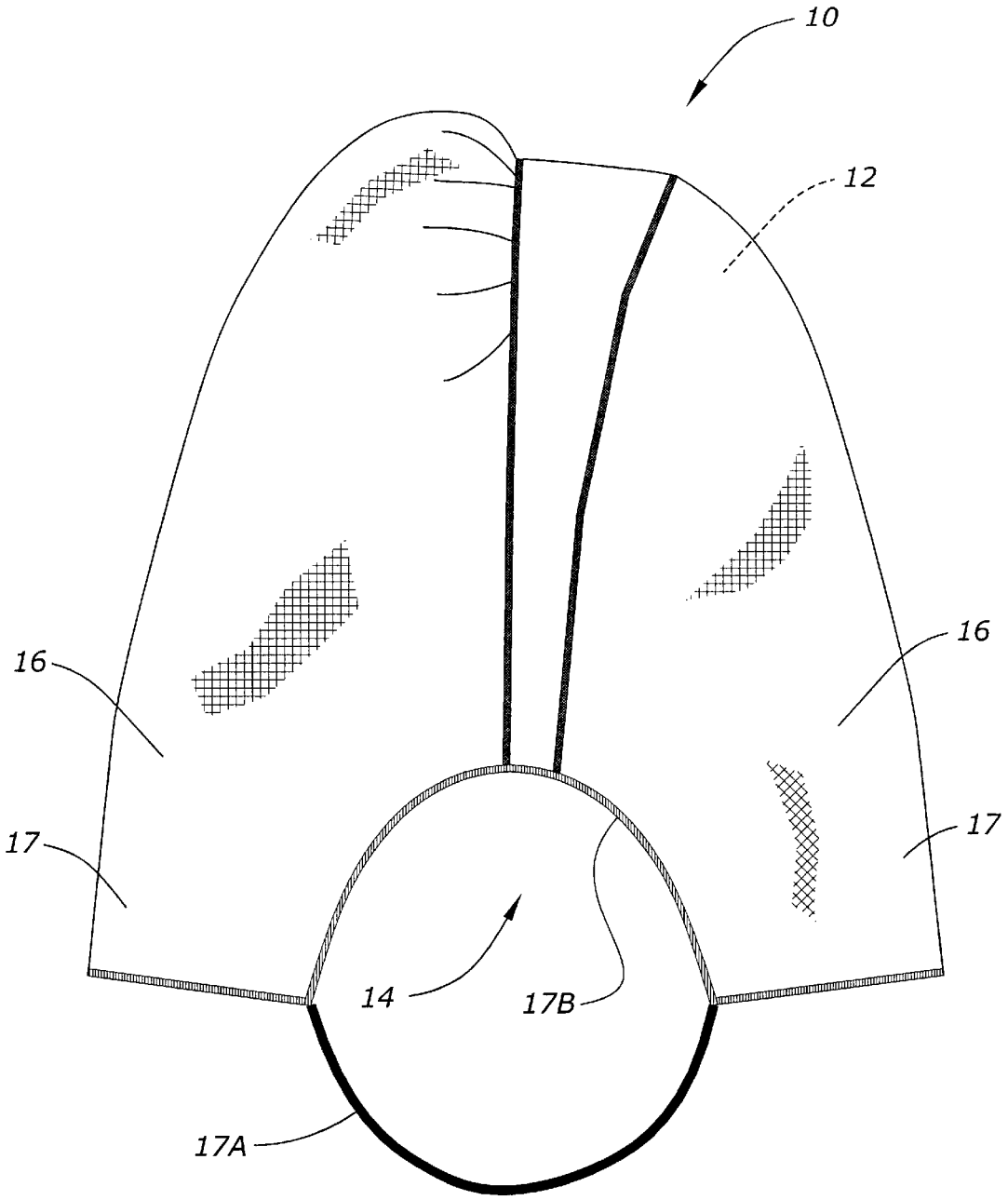
FIG. 4 is a side elevational view of the headnet mounted on a wearer as seen from the lefthand side of FIG. 2.
Figure 5:
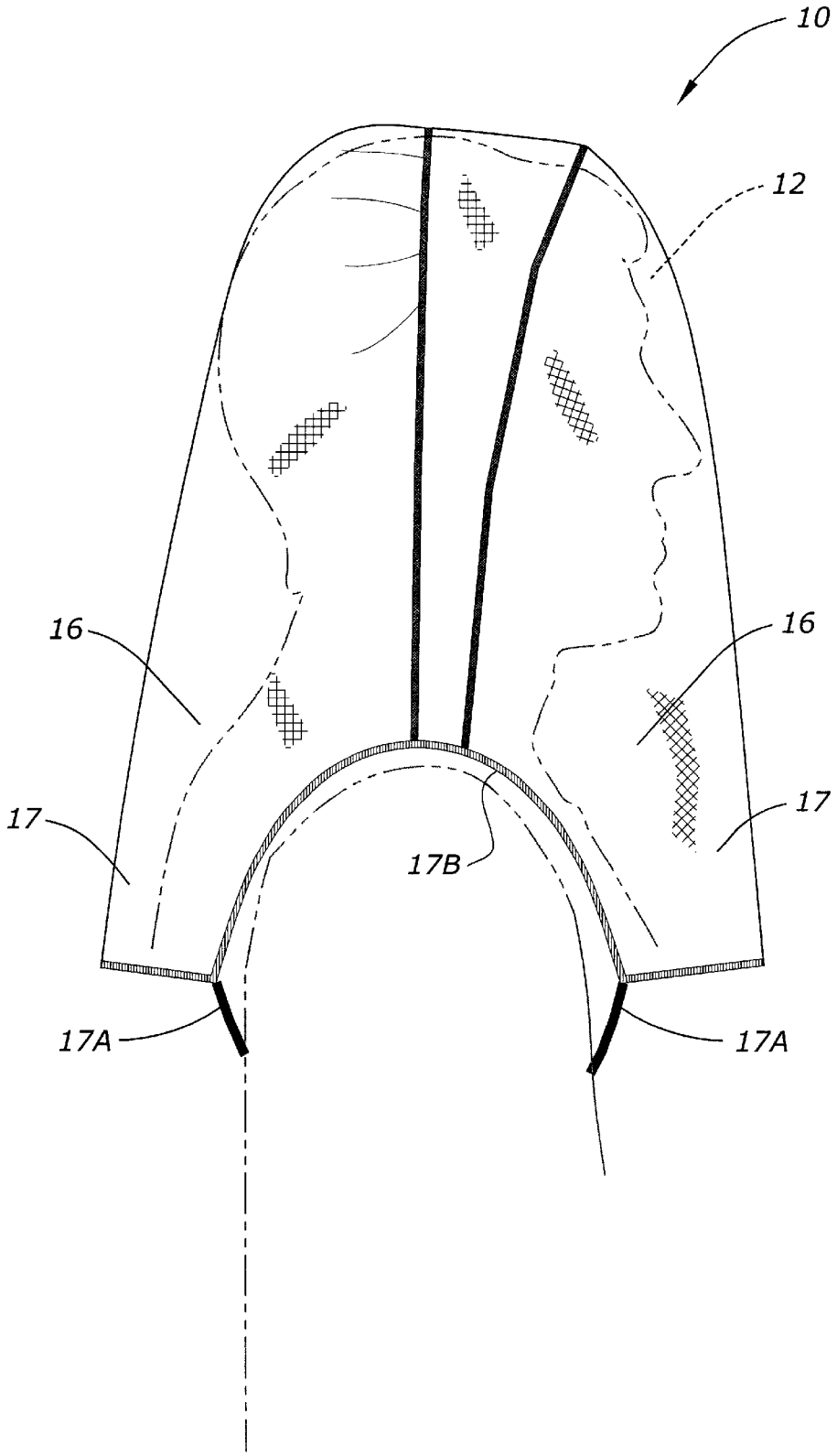
FIG. 5 is a side elevational view of the headnet mounted on a wearer as seen from the lefthand side of FIG. 2.
Figure 6:
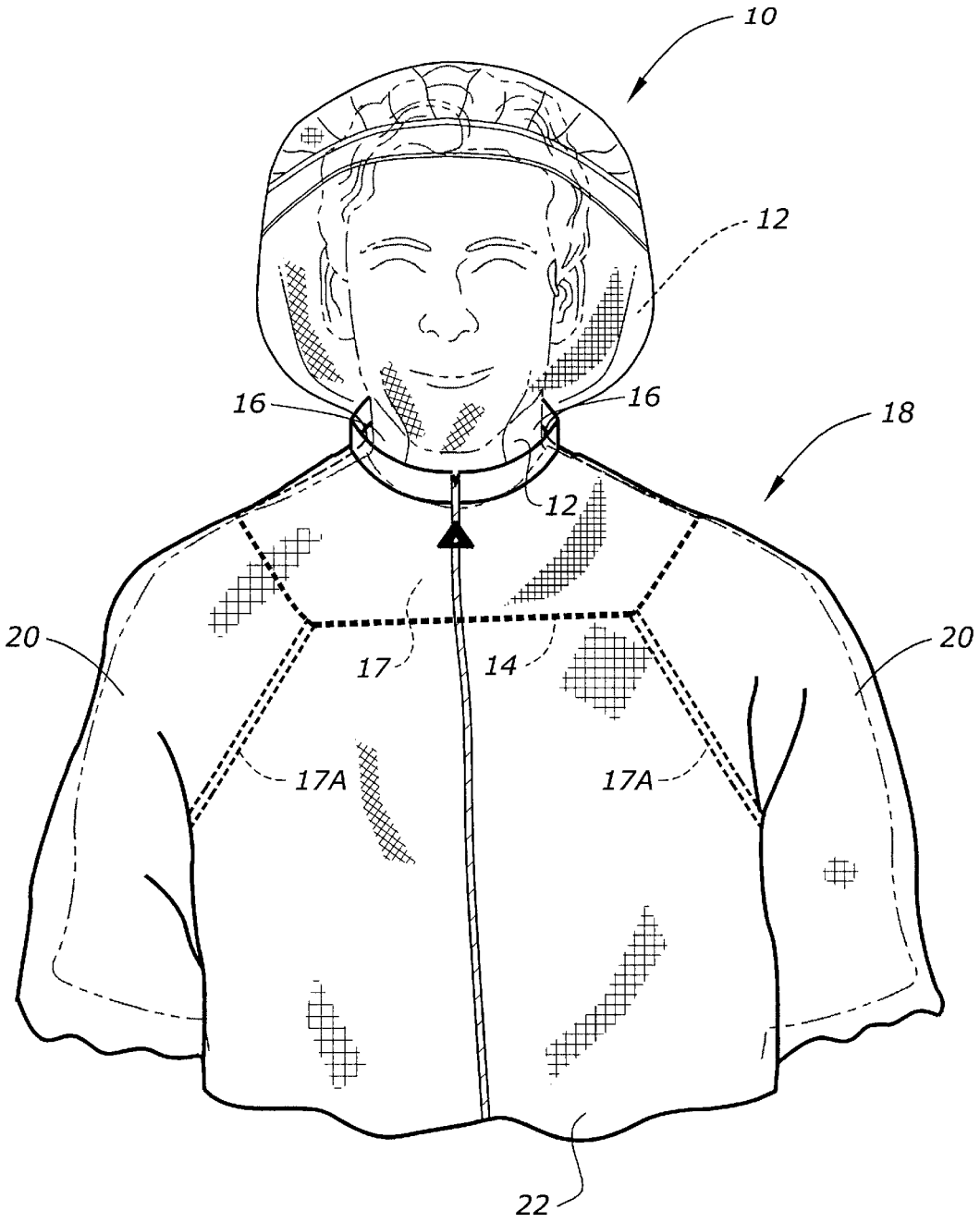
FIG. 6 is a front elevational view of the headnet and jacket being worn.

The numeral 18 designates a jacket of the same material as the headnet. (FIG. 3). Jacket 18 has two conventional arms 20 extending from a conventional jacket body 22. Jacket 18 has a closable neck portion or opening 24 to fit around the neck of the wearer. The diameter and cross section of the closed neck portion 24 is slightly larger than the neck of the wearer, but substantially smaller than the skirt portion 16 of the headnet 10.

When the wearer puts on the jacket 18 and the headnet 10, the skirt portion 16 is placed inside the neck portion 24 so that the skirt portion 16 is essentially inside the jacket in overlapping condition. The closure of the neck opening or portion 24 by zipper 26 compresses the skirt portion 16 around the neck of the wearer, so that insects cannot pass between the overlapping portions of the jacket 18 and the skirt 16 of headnet 10.

Figure 7:
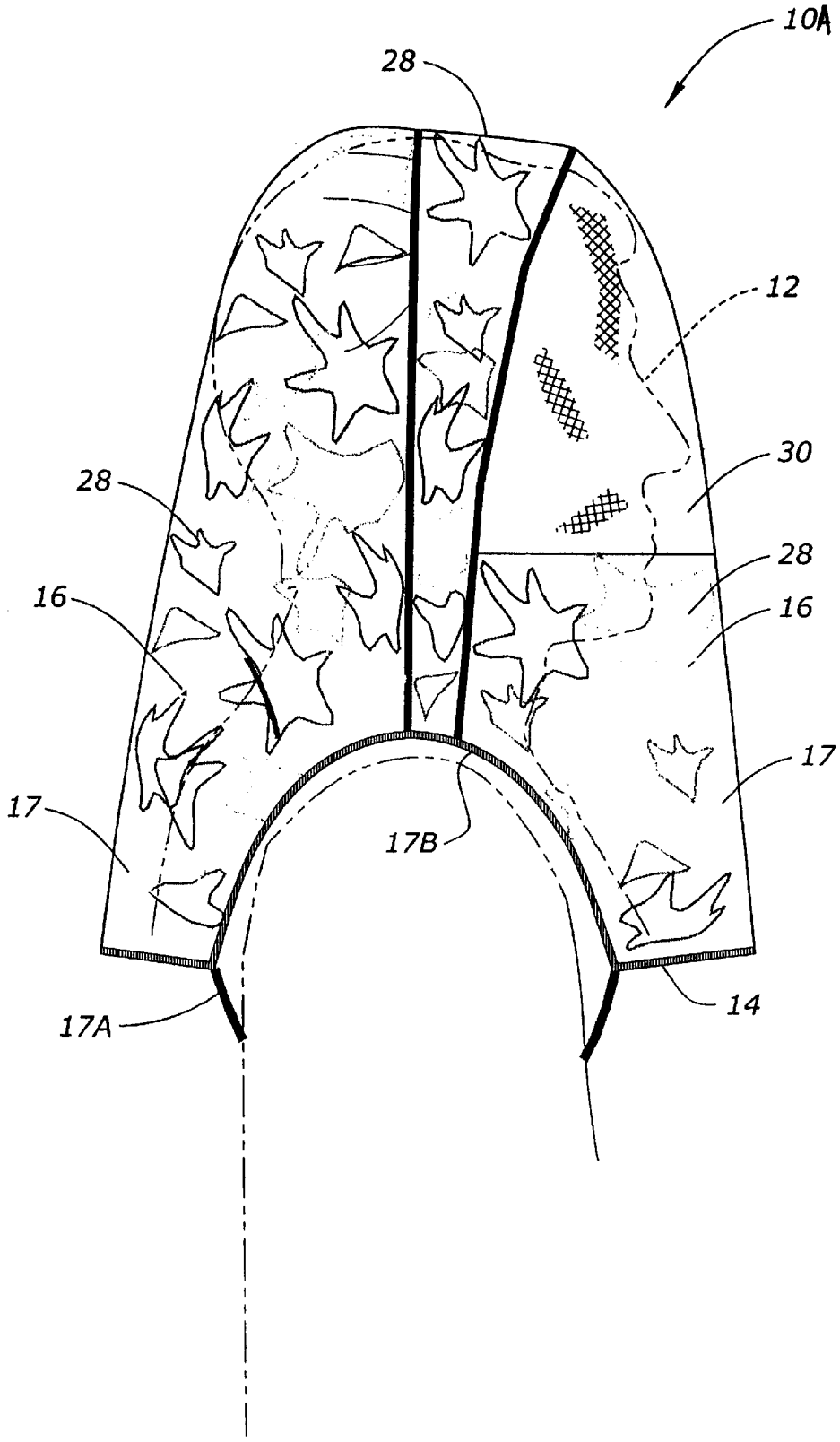
FIG. 7 is a view similar to that of FIG. 5 showing an alternate form of headnet.

An alternate form of the invention is shown in FIG. 7 wherein a headnet 10A is comprised of the same material as headnet 10. However, all of the headnet 10A has a camouflage pattern 28 imposed thereon except for a face portion 30. The open mesh material is present throughout headnet 10A to provide good ventilations, and the pattern 28 does not inhibit this function. However, normal visibility through the pattern 28 is inhibited so that that pattern is not imposed over the face portion 30.

Thus, it is seen that this invention will accomplish at least all of its stated objectives.

I claim:

1. A combination of a separate headnet and a jacket comprised of open mesh fabric to exclude the passage of insects, comprising, a headnet having a head receiving compartment with an open bottom, the headnet having a lower skirt portion extending downwardly from the head of the wearer, and a jacket having a body portion, two arm portions, and a closable neck portion having a horizontal cross section greater than the neck of a wearer and being of such size and shape to completely encircle and encompass the neck of the wearer, but less than a horizontal cross section of the skirt portion, whereupon when the closable neck portion is closed around and over the skirt portion in overlapping condition, the skirt portion will be compressed towards the neck of the wearer to completely encircle and encompass the neck of the wearer to inhibit the passage of insects between the overlapping condition of the headnet and the neck portion of the jacket.

2. A combination of a separate headnet and a jacket comprised of open mesh fabric to exclude the passage of insects, comprising, a headnet having a head receiving compartment with an open bottom, the headnet having a lower skirt portion extending downwardly from the head of the wearer, and a jacket having a body portion, two arm portions, and a closable neck portion having a horizontal cross section greater than the neck of a wearer, but less than a horizontal cross section of the skirt portion, whereupon when the closable neck portion is closed around and over the skirt portion in overlapping condition, the skirt portion will be compressed towards the neck of the wearer to inhibit the passage of insects between the overlapping condition of the headnet and the neck portion of the jacket, wherein a camouflage pattern is imposed on an outer surface of the headnet except for a face portion located in front of the face of the wearer.

3. A combination of a separate headnet and a jacket comprised of open mesh fabric to exclude the passage of insects, comprising, a headnet having a head receiving compartment with an open bottom, the headnet having a lower skirt portion extending downwardly from the head of the wearer, and a jacket having a body portion, two arm portions, and a closable neck portion having a horizontal cross section greater than the neck of a wearer, but less than a horizontal cross section of the skirt portion, whereupon when the closable neck portion is closed around and over the skirt portion in overlapping condition, the skirt portion will be compressed towards the neck of the wearer to inhibit the passage of insects between the overlapping condition of the headnet and the neck portion of the jacket, wherein a pair of U-shaped straps are suspended downwardly from the headnet to extend under the arms of the wearer to pull the headnet downwardly to hold the headnet on the head of the wearer.

4. The combination of claim 1 wherein a pair of opposite arcuate portions are formed in the skirt portion to conform to the shape of shoulders of the wearer.

5. The combination of claim 3 wherein a pair of opposite arcuate portions are formed in the skirt portion to conform to the shape of shoulders of the wearer.

* * * * *